US005387119A

United States Patent [19]

Wood

[11] Patent Number: 5,387,119

[45] Date of Patent: Feb. 7, 1995

[54] WATERPROOF ELECTRICAL CONNECTOR

[75] Inventor: Richard G. Wood, Magnolia, Tex.

[73] Assignee: Tescorp Seismic Products, Inc., Houston, Tex.

[21] Appl. No.: 134,075

[22] Filed: Oct. 8, 1993

[51] Int. Cl.[6] ..... H01R 13/52

[52] U.S. Cl. ..... 439/281; 439/589

[58] Field of Search ..... 439/278, 281, 606, 750, 439/587, 589, 736

[56] References Cited

U.S. PATENT DOCUMENTS

| | | | |
|---|---|---|---|
| H 113 | 8/1986 | McNeel | 439/282 |
| 2,881,406 | 4/1959 | Arson | 439/589 |
| 3,641,479 | 2/1972 | O'Brien et al. | 439/277 |
| 3,783,434 | 1/1974 | Ransford | 439/281 |
| 3,954,154 | 4/1976 | Kruppenbach et al. | 181/112 |
| 4,090,759 | 5/1978 | Herrmann | 439/281 |
| 4,150,866 | 4/1979 | Snyder et al. | 439/275 |
| 4,284,312 | 8/1981 | Patchett et al. | 439/281 |
| 4,305,636 | 12/1981 | Jackson et al. | 439/589 |
| 4,691,430 | 9/1987 | Wheeler | 439/736 |
| 4,767,349 | 8/1988 | Pottier et al. | 439/191 |
| 4,767,356 | 8/1988 | Grappe | 439/455 |
| 5,120,268 | 6/1992 | Gerrans | 439/736 |
| 5,145,410 | 9/1992 | Maejima et al. | 439/587 |

FOREIGN PATENT DOCUMENTS

| | | | |
|---|---|---|---|
| 63398 | 8/1968 | German Dem. Rep. | 439/281 |
| 2131633 | 6/1984 | United Kingdom | 439/587 |

*Primary Examiner*—Gary F. Paumen

*Attorney, Agent, or Firm*—P. Weston Musselman, Jr.

[57] ABSTRACT

The present invention is directed to an open-face waterproof, underwater matable electrical connector which can be used in marine seismic operations. The male plug is of a one-piece construction and made of a molded relatively hard and rigid plastic, with electrical connectors encapsulated therein. The body of the female receptacle is of a one-piece construction and made of a relatively soft plastic, with electrical sockets encapsulated therein. The electrical connector also preferably includes an external elongated tubular shell or housing made of a high density plastic material.

12 Claims, 1 Drawing Sheet

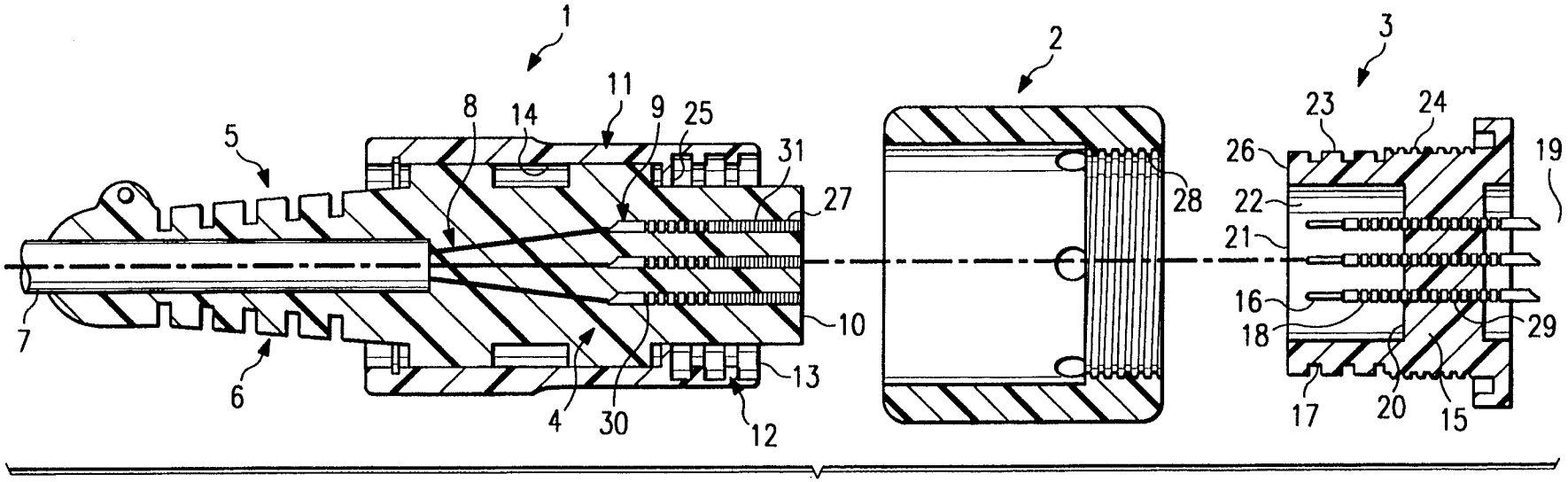
1
2
3
4
5
6
7
8
9
10
11
12
13
14
15
16
17
18
19
20
21
22
23
24
25
26
27
28
29
30
31

WATERPROOF ELECTRICAL CONNECTOR

BACKGROUND OF THE INVENTION AND DISCUSSION OF PRIOR ART

Underwater electrical cables and electrical connectors cause major problems when they leak. Leakage is common due to the fact that such cables, and their connectors, commonly operate in subsurface environments or in near surface atmospheric environments characterized by extreme salt and humidity. Frequently, the male and female portions of these connectors are each constructed of a separate core and housing, which must be bonded together. Such connectors can have problems with leakage in the area of the bond between each core and housing. Additionally, the cores and housings of these connectors are often made of different materials. As a result, bonding at the interface between the different materials is imperfect and can cause water leakage problems.

The general object of the present invention is to provide an electrical connector which solves the water leakage problems described above and which can be utilized in marine seismic operations. Another object of the invention is to provide an electrical connector which is open-face waterproof. Still another object of the invention is to provide an electrical connector which can provide a water-tight connection even if connected while under water.

SUMMARY OF THE INVENTION

The present invention is directed to an open-face waterproof, underwater matable electrical connector which can be used in marine seismic operations. The electrical connector assembly comprises a male plug portion and female receptacle portion. The male plug portion has a core with a plurality of electrical pin-type contact connectors encapsulated therein. The core of the male portion is integrally formed from a homogeneous, relatively hard and rigid plastic material to create an inseparable body. The female portion has a body with a plurality of electrically conductive metal sleeves disposed at the bottom of respective socket openings formed therein. The body of the female portion is integrally formed from a homogeneous, relatively soft plastic material. The electrical connectors encapsulated within the male portion are surrounded over a portion thereof with a sheath which is integrally formed with and of the same material as the core of the male portion. The electrical sockets in the female portion have at least one radially inwardly extending sealing rib for sealingly engaging the sheath portion of the electrical connectors of the male plug portion in a substantially watertight manner and acting as a barrier to seepage of water into the interior of the sockets of the female receptacle portion. The male and female portions of the connector are releasably engageable with one another to releasably maintain the sockets and connectors in their substantially watertight sealing engagement.

Use of a respective single composition in the construction of the male portion and female portion of the electrical connector assembly eliminates an interface between two materials, obviates the shortcomings of the prior art, and enables the production of electrical connectors capable of operational advantages over the prior art but which are markedly simpler to make and less expensive.

An additional feature of the invention is that each pin and socket connection is individually sealed. The female portion of the connector contains individual sealing ribs for each socket, whereas prior art electrical connectors typically have one O-ring around the outer circumference of the connector housing. If an electrical connector with a single O-ring design is not coupled in correct alignment, the O-ring will let water into the connector housing, which can cause problems with the electrical connections of some designs. With the present connector, a misaligned connection may allow water inside a housing, but the individual sealing ribs will act to maintain a good connection at each pin and socket. This important characteristic is referred to in the following description, abstract and claims as "open-face waterproof" and means that the individual electrical contact connections within a connector are sealed even if the face surfaces of the male and female components are exposed to water under pressure. More specifically, the phrase "open-faced waterproof" means that the sealing of the electrically conductive components, against the entrance water under pressure, is not dependent on a seal provided by a housing around the connector nor by contact between the respective faces of the male plug and female receptacle members of an electrical connector.

The above advantages, and numerous other features and advantages of the invention, will become more readily apparent upon a careful reading of the following detailed description, claims and drawings, wherein like numerals denote like parts in the several views, and wherein:

BRIEF DESCRIPTION OF THE DRAWING

The drawing FIGURE is a longitudinal cross-sectional view of the present invention.

DETAILED DESCRIPTION OF A PREFERRED EMBODIMENT

As shown in the drawing FIGURE, a waterproof electrical connector assembly 1 for underwater and/or marine environment usage in general is provided. The particular embodiment shown in FIG. 1 is for a connector attachment at an underwater seismic data acquisition unit. The connector assembly includes a female receptacle portion 1, a mounting nut 2, and a male plug portion 3. The overall configuration of the female receptacle 1 is shown in FIG. 1, and includes a generally cylindrical inner member or body 4 that can be made, for example, of a suitable synthetic elastomer. The rear end of the inner member 4 is molded integrally with a stress relief device 5 which can include a conical-shaped series of spaced elastomer rings 6. The insulated conductor cable 7 passes through the stress relief device 5 and into, and through, the body member 4. At a location within the body member 4, the conductor wires 8 in the cable 7 are brought out and attached to conductive metal sleeves at the respective rear ends of a plurality of sockets 9. The sockets 9 are arranged in a certain pattern, such as five at 60 degrees around a center socket. The sockets 9 open to the outside of the front end surface 10 of the body member 4, the bottom socket position being omitted so that the pins and sockets can be engaged in only one relative angular position.

Another part of the connector assembly is an elongated tubular shell 11 which preferably is made of a high density plastic material. The shell 11 is rotatably mounted on the female body member 4 and has a forward portion 12 that is internally threaded at 13. The shell 11 spans a substantial portion of the body member 4, and the bore 14 of the shell 11 is sized such that it can be easily rotated by hand relative to the body member 4. Longitudinal ribs can be provided on the shell 11 as an aid to turning.

The overall configuration of the male plug portion 3 also is shown in FIG. 1. The male plug portion 3, which is configured in the present embodiment to be mounted to a sidewall of a data acquisition unit with mounting nut 2, includes a central body or core 15 and a tubular wall 17 which are mold formed around a plurality of connector pins 16. The core 15 and the tubular wall 17 are integrally formed in a one-piece construction, and are preferably manufactured of glass impregnated polyurethane.

The connector pins 16 are elongated metal members with rounded ends and are arranged in the same pattern as the sockets 9. A portion of each connector pin 16 is covered by a sheath 18 which is formed integrally with the core 15 and the tubular wall 17, and made of the same material. Thus, the core 15, the tubular wall 17, and sheath 18 of the male plug portion 3 are of a one-piece construction. A conductor wire 19 is soldered to the rear side of each connector pin 16 to electrically connect the respective pins 16 to an electrical circuit. Core 15 has an end face 20 which is inwardly recessed from the open end 21 of the tubular wall 17 thus forming an interior space 22.

In the preferred embodiment, the core 15 has two sets of threads 23, 24, formed on an external surface thereof. Threads 23 match the internal threads 13 on the forward end portion of the shell 11. Threads 24 match with internal threads 28 in the mounting nut 2. The mounting nut 2 is used if the connector assembly is to be mounted in the sidewall panel of a data acquisition unit. If an in-line connector assembly is desired, the connector assembly can be modified in a manner known to those with skill in the art so as to eliminate the mounting nut 2. In the panel mount configuration shown in FIG. 1, the male plug 3 is made of rigid plastic because it is mounted to the panel of a data acquisition unit. In another embodiment, female receptacle 1 could be mounted to the data acquisition unit and would then be made of a relatively rigid plastic while the male plug 3 would be made of a relatively soft plastic. For an in-line connector, either the female receptacle 1 or the male plug 3 could be made of the relatively rigid plastic with the other member being made of relatively soft plastic.

As the threads 23 and 13 are progressively engaged by right hand rotation of the shell 11, the sockets 9 are forced to telescope over the connector pins 16 as the front portion and face 10 of the body 4 is advanced into the tubular wall 17, forcing water out of cavity 22, and a water-tight seal is achieved. When the threads 13 and 23 are made up hand tight, the front end surface 10 is up against the end face 20 of the core 15 of the male plug 3 and the interior face 25 of the shell 11 is up against the end face 26 of tubular wall 17.

The sockets 9 have a particular configuration as shown in FIG. 1. Each socket 9 includes the aforementioned conductive metal sleeves at the respective bottom, or rear end, of each socket and up to four axially spaced and inwardly extending sealing ribs 27 which are integrally molded as part of the body member 4. The inner diameter of each sealing rib 27 is smaller than the cross-sectional area of its respective connector pin sheath 18. Thus, when the connector pin 16 is inserted into its respective socket 9, the connector pin sheath 18 radially compresses the resilient sealing ribs 27 which then provide a seal effective to isolate each set of mating connector pin 16 and socket 9 from each other and from the surrounding environment, to provide a leak-proof connector. Upon mating, the exposed portion of each connector pin 16 is encapsulated by a respective metal sleeve 31 of the female receptacle 1. When the connector is assembled under water the presence of residual water between each connector pin 16 and its respective socket 9 will not cause short circuiting between the sets of connector pins 16 and metal sleeves 31 since the seal is also electrically insulating.

The connector pins 16 also have a particular configuration as shown in FIG. 1. Each connector pin 16 has one or more axially spaced and radially inwardly extending grooves 29 machined into it. The plastic material of male plug portion 3 is preferably injection molded around the connector pins 16. As the plastic material cools immediately following the injection molding step some shrinkage occurs and the plastic fills in the grooves 29, thus creating a water barrier and making the male plug 3 open-face waterproof. That is, without any external sealing, and even without coupling with the female receptacle, water under significant pressure cannot leak around the pins to the rear of the plug and short across the conductors attached to the plug. Similarly, each of the metal sleeves at the rear end of each socket 9 also has one or more axially spaced and radially inwardly extending grooves 30 machines into it. As with the injection molding of the male plug 3, as the body of the female receptacle 1 is injection molded, the plastic material cools and shrinkage occurs with the plastic filling in the grooves 30, making the female receptacle 1 open-face waterproof.

In the preferred embodiment, the core 15, the tubular outer wall 17, and the connector pin sheath 18 of the male plug portion 3 is made of polyurethane, which may be glass impregnated polyurethane. However, any rigid non-hydroscopic plastic with good electrical properties could be used.

Because the inner core 15, tubular wall 17, and connector pin sheath 18 are made of the same material they may be molded in one piece, whereby no voids are produced. When glass impregnated polyurethane is molded it sets up as a rather hard if not semi-rigid body. The glass imparts strength as well as rigidity to the body. In the event it is desired to increase the hardness to better withstand abrasion and/or harsh treatment during usage, the fiber-glass content may be increased or conversely, lowered. It is believed that a fiberglass content in the range of 15% to 65% by weight would generally accomplish the objects of the invention as described herein.

The body 4 of the female receptacle 1 can be made of a relatively soft molded polyurethane material with a durometer of about 80, but modifications are possible and material substitutions permissible. Specifically, thermosetting plastic material could be used in place of thermoplastic for body 4. A greater or lesser durometer could be used as long as distortion is possible with manually applied insertion forces.

The aforementioned materials are proposed by way of example for use in connection with the current invention. These materials, and any other constituting a substantial equivalent and appropriate for the purpose here intended may, when used in accordance with techniques recommended by the manufacturers, be used for molding, through injection or other appropriate techniques the male plug 3 and female receptacle 1 of the electrical connector hereof.

It will now be recognized that a new and improved waterproof electrical connector assembly that meets the objects of the present invention, and which has each of the features and advantages noted above, has been disclosed. Since certain changes or modifications may be made in the disclosed embodiment without departing from the inventive concepts involved, it is the aim of the appended claims to cover all such changes and modifications that fall within the true spirit and scope of the present invention.

What is claimed is:

1. An electrical connector assembly for use in marine and corrosive environments comprising: a connector body formed of a relatively soft plastic material; a connector core formed of a relatively hard and rigid plastic material, said body and core being configured to allow telescoping interaction together when assembled; said core being integrally formed with a tubular walled outer portion that is closed at one end and open at the other and having a plurality of electrical contact members encapsulated in said core, each of said contact members having a predetermined length that is surrounded by a sheath along a portion of said length, sheath being formed as one piece with the core, said contact members each being arranged for engagement with a respective electrical sleeve disposed in a corresponding socket molded in said body, each of said sockets having at least one radially inwardly extending sealing rib integrally formed on an internal wall surface thereof and forming a waterproof seal between a respective socket and a respective sheath disposed therein solely in response to inserting the contact members into electrical contacting engagement with the sleeves disposed in said sockets; and an electrical conductor connected to each of said contact members and said sockets.

2. The electrical connector assembly of claim 1, wherein each of said electrical connector contact members has a plurality of axially spaced and radially inwardly extending grooves to prevent the passage of water between the contact member and said sheath surrounding a portion of the length of the contact member.

3. The electrical connector assembly of claim 1, wherein said electrical sleeve disposed in each of said sockets has a plurality of axially spaced and radially inwardly extending grooves to prevent the passage of water between the sleeve and internal wall surface of said socket.

4. The electrical connector assembly of claim 1, wherein the relatively soft plastic material is polyurethane.

5. The electrical connector assembly of claim 1, wherein the relatively hard and rigid plastic material is fiberglass impregnated polyurethane.

6. The electrical connector assembly of claim 1, wherein said electrical connector assembly is open-face waterproof.

7. An electrical connector assembly comprising:

a male plug portion having a core formed of a relatively hard and rigid plastic material having a defined hardness and a face surface, a plurality of electrical contact pins arranged in a predetermined pattern and having a predetermined length and being partially encapsulated within said core and partially extending outwardly from said face surface, a plurality of sheaths integrally formed with said core and extending outwardly from the face surface of said core and completely around said pins over at least a portion of the length of said pins, and a tubular wall extending outwardly from the face surface of said core in radially spaced relationship with said pins and said sheaths;

a female receptacle portion having a body formed of a relatively soft material with respect to the material of said male plug portion and having a face surface and a plurality of socket openings arranged in a mating relationship with the predetermined pattern of said contact pins and extending inwardly into said body and having an electrical contact sleeve disposed at a bottom of each of the sockets, each of said sockets having a least one sealing rib extending radially inwardly from an internal wall surface defining each of said socket, said sealing rib being solely deformable by a corresponding one of the sheaths surrounding said contact pins to form a waterproof seal between said rib and said sheath in response to inserting the contact pins of said male plug portion into the contact sleeves of said female receptacle portion.

8. An electrical connector assembly, as set forth in claim 7, wherein each of the electrical contact pins partially encapsulated within the core of said male plug portion have at least one radially inwardly extending groove formed in an outer surface of said pin, said groove being filled with said core material whereby said groove and said core material in said groove cooperate to form a waterproof seal between said contact pins and said core.

9. An electrical connector assembly, as set forth in claim 7, wherein each of the electrical contact sleeves disposed at bottom of the sockets in the body of said female receptacle portion have at least one radially inwardly extending groove formed in an outer surface of said sleeve, said groove being filled with said body material whereby said groove and said body material cooperate to form a waterproof seal between said sleeves and said body.

10. An electrical assembly, as set forth in claim 7, wherein assembly includes a shell having a plurality of internal threads formed adjacent one end thereof and said male plug portion has a plurality of external threads disposed on an outer circumferential surface, said shell substantially surrounding said female receptacle portion in independently rotatable relationship with respect to said female receptacle portion, and said pins of the male plug portion being drawn into and maintained in electrical contact with the contact sleeves of said female receptacle portion in response to threadably engaging the internal threads of said shell with the external threads of said male plug portion.

11. An electrical connector assembly, as set forth in claim 7, wherein the relatively hard and rigid plastic material comprising the core, sheaths and tubular wall of said male plug portion is a fiberglass impregnated polyurethane material.

12. An electrical connector assembly, as set forth in claim 7, wherein the relatively soft material comprising the body of said female receptacle portion is a polyurethane material having a hardness of about 80 durometer.

* * * * *

UNITED STATES PATENT AND TRADEMARK OFFICE

CERTIFICATE OF CORRECTION

PATENT NO. : 5,387,119

DATED : February 7, 1995

INVENTOR(S) : Richard G. Wood

It is certified that error appears in the above-indentified patent and that said Letters Patent is hereby corrected as shown below:

On the title page and Drawing sheet, correct the drawing shown at element 27 of the Figure and to add the sheath identified as element 18.

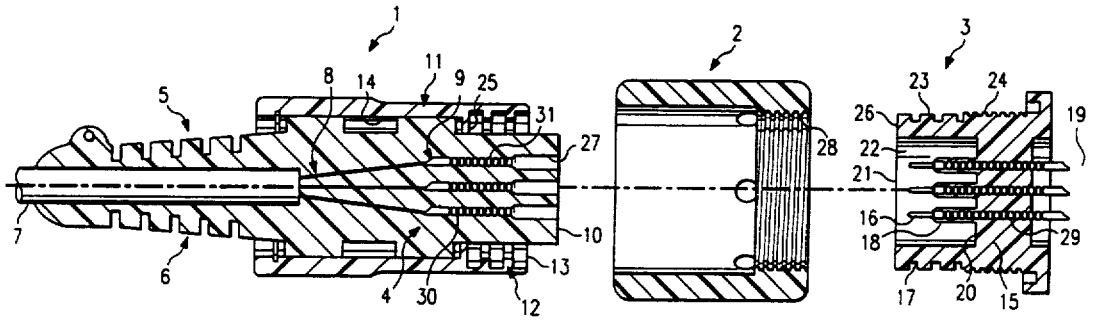

Signed and Sealed this

Eleventh Day of March, 1997

*Attest:*

*Attesting Officer*

BRUCE LEHMAN

*Commissioner of Patents and Trademarks*